US007553213B2

(12) United States Patent
Smith et al.

(10) Patent No.: US 7,553,213 B2
(45) Date of Patent: Jun. 30, 2009

(54) CONVERTIBLE APPAREL TOP WITH SWIVEL STRAPS

(75) Inventors: Annika P. Smith, 11901 Santa Monica Blvd., #383, Los Angeles, CA (US) 90026; Adrian Cruz, Los Angeles, CA (US)

(73) Assignee: Annika P. Smith, Los Angeles, CA (US)

( * ) Notice: Subject to any disclaimer, the term of this patent is extended or adjusted under 35 U.S.C. 154(b) by 0 days.

(21) Appl. No.: 12/006,743

(22) Filed: Jan. 4, 2008

(65) Prior Publication Data

US 2009/0047866 A1 Feb. 19, 2009

Related U.S. Application Data

(60) Provisional application No. 60/956,683, filed on Aug. 18, 2007.

(51) Int. Cl.
*A41D 3/00* (2006.01)

(52) U.S. Cl. ..... 450/86; 450/88

(58) Field of Classification Search ..... 2/73, 2/78.1–78.4, 326–331, 336, 338; 450/82, 450/86, 88, 1

See application file for complete search history.

(56) References Cited

U.S. PATENT DOCUMENTS

| | | | | |
|---|---|---|---|---|
| 1,491,578 | A | 4/1924 | Ballou et al. | |
| 1,650,916 | A | 11/1927 | Van Heusen | |
| 1,705,113 | A | 3/1929 | Harvey | |
| 2,023,612 | A | 12/1935 | Park et al. | |
| 2,033,961 | A | 3/1936 | Van Hollen | |
| 2,250,094 | A | 6/1941 | Comibert et al. | |
| 2,437,541 | A | 3/1948 | Koret | |
| 2,482,994 | A | 9/1949 | Wiley | |
| 2,628,357 | A | 2/1953 | Sider | |
| 2,657,392 | A | 11/1953 | Jackson | |
| 2,668,293 | A | 2/1954 | Levy | |
| 2,816,293 | A | 12/1957 | Graf | |
| 2,940,454 | A | 6/1960 | Faron | |
| 3,098,485 | A | 7/1963 | Howell | |
| 3,311,112 | A | 3/1967 | Murray | |
| 3,314,432 | A | 4/1967 | Erteszek | |
| 3,465,754 | A | 9/1969 | Lockwood et al. | |
| 3,473,167 | A | 10/1969 | Jeffrey | |
| 3,489,153 | A * | 1/1970 | Gaisser | 450/88 |
| 3,710,394 | A | 1/1973 | Trice | |
| 4,076,029 | A | 2/1978 | Wiquel | |
| 4,142,253 | A | 3/1979 | Roscoe | |
| 4,667,345 | A | 5/1987 | Jachowski | |
| 4,731,884 | A | 3/1988 | Lawrence | |
| 4,815,145 | A | 3/1989 | Chow | |

(Continued)

*Primary Examiner*—Gloria Hale
(74) *Attorney, Agent, or Firm*—Cislo & Thomas, LLP

(57) ABSTRACT

The present invention is directed to a convertible apparel top such as a brassiere, tank top, or dress having two straps attached to the garment on at least one end of the strap with a swivel mechanism such as a means for attaching so that the garment may be converted from a garment with straps to a strapless garment and vice versa. In one embodiment, the ends of the straps not attached with a swivel mechanism may be removeably attached to the garment to facilitate the conversion, and may be configured to attach both to the garment and to each other for multiple looks and configurations such as strapless, parallel straps, crisscross straps, and a halter without the risk of losing the straps.

6 Claims, 5 Drawing Sheets

U.S. PATENT DOCUMENTS 5,398,343 A 3/1995 Kuracina
5,416,928 A 5/1995 Koenig
5,564,131 A * 10/1996 Anscher ..... 2/340
5,664,257 A 9/1997 Hall
5,894,600 A 4/1999 Chenefront
5,911,618 A 6/1999 Dailey
6,009,556 A 1/2000 Nenninger
6,086,451 A 7/2000 Fernandes
6,186,861 B1 2/2001 Flaherty
6,205,585 B1 3/2001 Capparelli
6,206,752 B1 3/2001 Fagin et al.
6,279,171 B1 8/2001 Brancato
6,298,527 B1 * 10/2001 Fildan et al. ..... 24/689
6,308,334 B1 10/2001 Maas
6,321,422 B1 11/2001 Fildan et al.
6,431,947 B1 8/2002 Henz
6,517,409 B2 2/2003 Flaherty
6,547,636 B1 4/2003 Cato
6,857,936 B2 2/2005 Jones et al.
6,883,179 B1 4/2005 Crum
D506,592 S 6/2005 Mone et al.
7,051,407 B2 5/2006 Hsu
7,186,163 B2 3/2007 Carlucci
7,201,629 B2 4/2007 Lambru
7,238,081 B2 7/2007 Fildan et al.
7,255,627 B2 8/2007 Bodnar
2002/0022434 A1 2/2002 Plourde et al.
2007/0105482 A1 5/2007 Styles-Gaviria et al.

* cited by examiner

FIG. 2
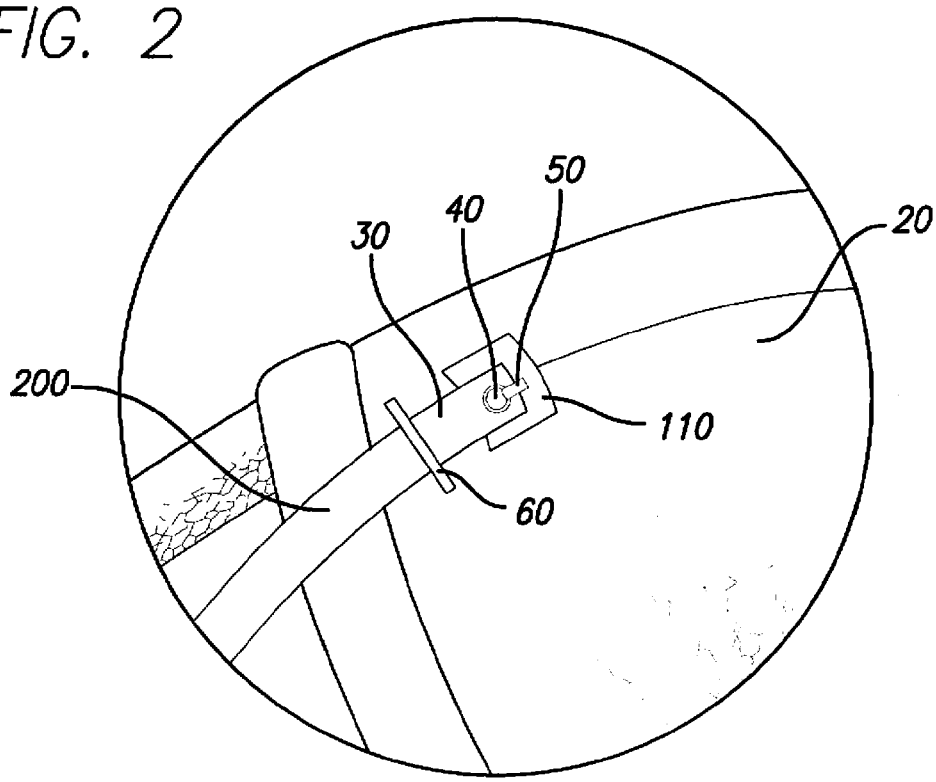
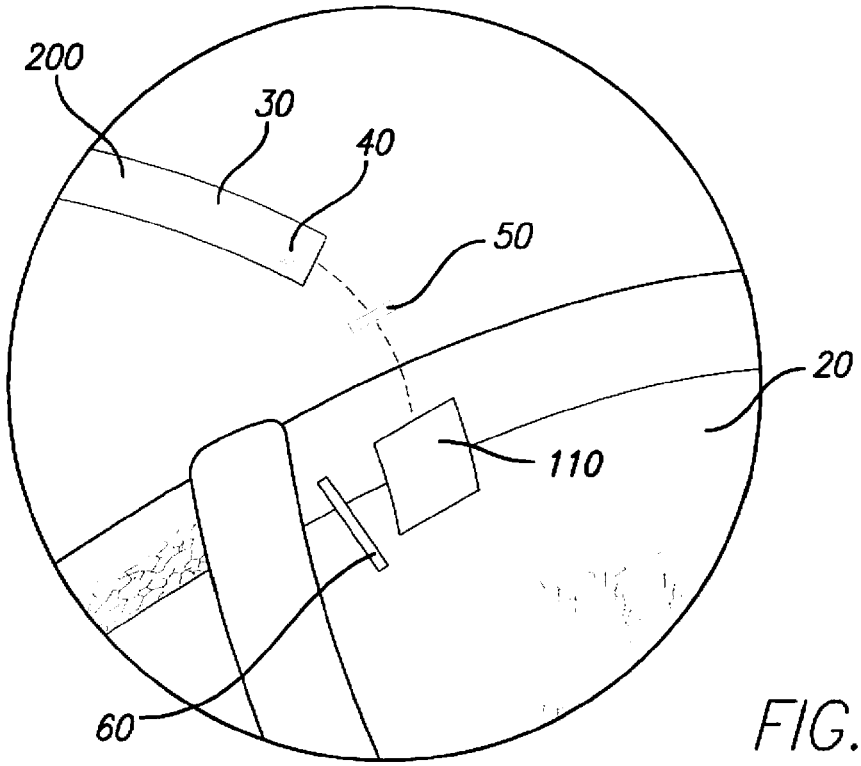
FIG. 3

CONVERTIBLE APPAREL TOP WITH SWIVEL STRAPS

CROSS-REFERENCES TO RELATED APPLICATIONS

This Application claims the benefit of Provisional Patent Application No. 60/956,683 filed on Aug. 18, 2007 by the present inventors, which is incorporated by reference in its entirety.

TECHNICAL FIELD

This invention relates to apparel that is designed to have convertible straps such as brassieres, tank tops, and dresses that permit adjustment and rearrangement of the straps to accommodate the wearer.

BACKGROUND ART

This invention relates to apparel, specifically apparel that is designed to have convertible straps. Currently there are apparel tops (such as tank tops and dresses and undergarment tops (such as bras)) that are designed to allow a wearer to completely remove or rearrange the straps of the garment. This allows the apparel tops and undergarments to be worn with a look using two straps, one strap, straps crossed at the front, straps crossed at the back, or no straps at all by removal of the straps in their entirety to achieve a strapless look.

The problem wearers face is that these straps are easily misplaced if removed.

Wearers then face an extra expense to replace the straps—if they can find matching straps—or find themselves with a garment that can now only be worn strapless or single strapped if only one strap can be located. Accordingly, there is a need in the art for the straps on a convertible garment to always be there when the user needs them, and be gone when the user does not need them. There are also convertible apparel and undergarment tops that have straps that detach and reattach at one end of the garment only. While the straps are difficult to lose in this design, these tops are not designed to convert easily to a strapless look. This invention solves this problem and has a multitude of embodiments.

DISCLOSURE OF INVENTION

The present invention is a convertible apparel top such as a tank top, dress, or brassiere having a bodice section with two cups and one or more bands extending there from; one or more swivel mechanisms attached to the cups in the bodice section to comfortably fit against the wearer; one or more shoulder straps, each having a first end and a second end, the first end of each strap attached to a swivel mechanism, the first end of the strap can be rounded to facilitate the swivel, and the second end of each strap having an attachment piece, wherein the first end of each strap has a reinforced opening, an eyelet, or other suitable reinforcement and each swivel mechanism is a strong piece of material affixed to the front inside of each cup that passes through the reinforced opening, eyelet, or suitable enforcement in the first end of each strap to secure the first end of each strap to the front inside of said cups and to permit the straps to swivel; one or more releasable attachment mechanisms on the inside of the one or more bands in the bodice section to removably receive the attachment pieces on the second ends of the straps; a fabric sheath over each swivel mechanism; and one or more anchors on the inside of the one or more bands in the bodice section to removeably receive each of the one or more straps, the swivel mechanisms permitting movement of the one or more straps so that the position of the one or more straps can be modified so that the apparel top has multiple configurations, and wherein the attachment pieces on the second ends of each of the one or more straps are configured to removably engage together and to removably engage each of the one or more releasable attachment mechanisms on the inside of the bands in the bodice section.

The straps in the convertible apparel top can be adjustable in length such that the length enables the shoulder straps to extend from the swivel mechanisms to the releasable attachment mechanisms over the shoulder of a wearer in a configuration where the shoulder straps are parallel to each other or the shoulder straps are in a crisscross formation. Alternatively, the adjustable shoulder straps can be extended or shortened to extend from the swivel mechanisms to the releasable attachment mechanisms about the neck of a wearer to form a halter.

Another embodiment of the present invention is a method of converting a convertible brassiere from a first conventional top configuration to a second strapless configuration, while maintaining attachment of the one or more straps each having a first and second end including the steps of: providing a brassiere top with two cups and one or more bands extending therefrom, and converting the top by detaching one of the first or second ends from each of the shoulder straps from the bodice section, swiveling the two shoulder straps away from the front center of the bodice section and towards the side of the bodice section, and inserting the two shoulder straps into anchors inside the one or more bands of bodice section.

In yet another embodiment, the convertible apparel top such as a brassiere, tank top, or dress comprises a bodice section, one or more means for attaching one or more straps to the bodice section, the means for attaching permitting the one or more straps to swivel in relation to the bodice section are selected from the group consisting of a strong material, cord, string, thread, textile fabric, rope, prong, button, wire, cable, and combinations thereof.

The convertible apparel top may have four means for attaching. This provides for swiveling on both ends of the one or more straps so that a user can retain connectivity of both the first and second ends of the one or more straps to the apparel top while converting the top from having straps to strapless or vice versa.

In yet another embodiment, the means for attaching are covered with a fabric sheath to protect the wearer. The convertible apparel top may have two means for attaching, either in the front or the back of the apparel top. In this instance one of the first or second ends of the one or more straps is attached to each of the means for attaching.

The first or second ends of the one or more shoulder straps that are attached to the attachment means have a reinforced opening, an eyelet, grommet, or other suitable reinforcement that may be covered in fabric, plastic, metal, or other man-made or natural material that is sturdy such that the reinforced opening is reforced by these named materials. The reinforced opening may be surrounded by fabric, plastic, or metal to add to the comfort of the wearer and to strengthen and stabilize the end of the strap and the opening that is attached to the means for attaching also called the swivel mechanism. To further enhance the comfort of the user, the two means for attaching on the bodice section may be covered with a fabric sheath. The one or more means for attaching may be on the inside or outside of the convertible apparel top and may be on the front, back, or both sides of the top. The first or second ends of the one or more shoulder straps that are attached to the attachment means may have a rounded edge.

The means for attaching, also called the swivel mechanism in the inventive convertible apparel top may be a strong piece of material, affixed to the bodice section and holding each of the first ends or the second ends of the shoulder straps. The strong piece of material that attaches the one or more shoulder straps to the bra or bodice section to allow for a swiveling motion of the one or more straps may have a miniature bowtie or hourglass shape such that the wider ends affix to the cup of the bra or the bodice section and the more slender mid portion remains threaded through the one or more shoulder straps. Preferably the slender mid portion is threaded through the reinforced opening in the one or more straps. Alternatively, the means for attaching, also the swivel mechanism, in the inventive convertible apparel top may be a cord, strong string, twine, cable, thread, elastic, rope, wire, cable and combinations thereof that are affixed to the bodice section and holding each of the first ends or the second ends of the one or more shoulder straps through a reinforced opening, an eyelet, grommet, or other suitable reinforcement in the first ends of the shoulder straps. The means for attaching, also the swivel mechanism, may be a button or round shape piece affixed to the bodice section, a prong, a prong with a flat piece and a narrow piece, the narrow piece to be inserted through the end of a strap and into the garment and the flat piece serving to hold the strap next to the garment, a joint mechanism comprised of two pieces which turn round with respect to each other on a longitudinal pin or axis, holding the eyelet in the first or second ends of each of the one or more straps in place, a peg, hinge, spring, rod, rotatable snap, and combinations thereof.

BRIEF DESCRIPTION OF DRAWINGS

FIG. 2 is a detailed depiction of the swivel mechanism or means for attaching, and the first end of a strap when the strap is in the down position and threaded through an anchor on the garment to hold the strap in place for a strapless look.

FIG. 3 is a detailed depiction of the eyelet in the first end of the strap before it is attached to the swivel mechanism or means for attaching, and the swivel mechanism deconstructed where a strong piece of material is shown between the first end of the strap such that it will be affixed to the inside of the cup of the garment and will be threaded through the eyelet to hold the strap in a swiveled relation to the garment as shown in FIG. 2.

BEST MODE FOR CARRYING OUT THE INVENTION

The convertible apparel top with convertible swivel straps creates a convenient way for a wearer to convert a garment top from a strapped to strapless look with straps that are still anchored to the garment in such a way as to prevent their full separation from the garment and prevent loss of the strap(s). This also saves the wearer the trouble of having to search for the straps when wishing to go from strapless to a strapped look. If the top is a tank top, it partially or fully covers the top torso, whereas if the top is a dress, it partially or fully covers the torso, waist, and part or all of the legs.

The convertible apparel top; for example, a brassiere also called a bra, tank top, or dress can be made of any suitable material, can be without a closure, have a front closure, back closure, side closure, top closure or bottom closure. In one embodiment of the present invention, the apparel top has strategically placed holes or openings to allow for the swivel strap to be attached, pulled through or inserted. In another embodiment the apparel top is created with mechanism that is designed to hook, snap, or otherwise connect to a sister piece on the ends of each strap to allow for a swiveling motion.

Figure 1:
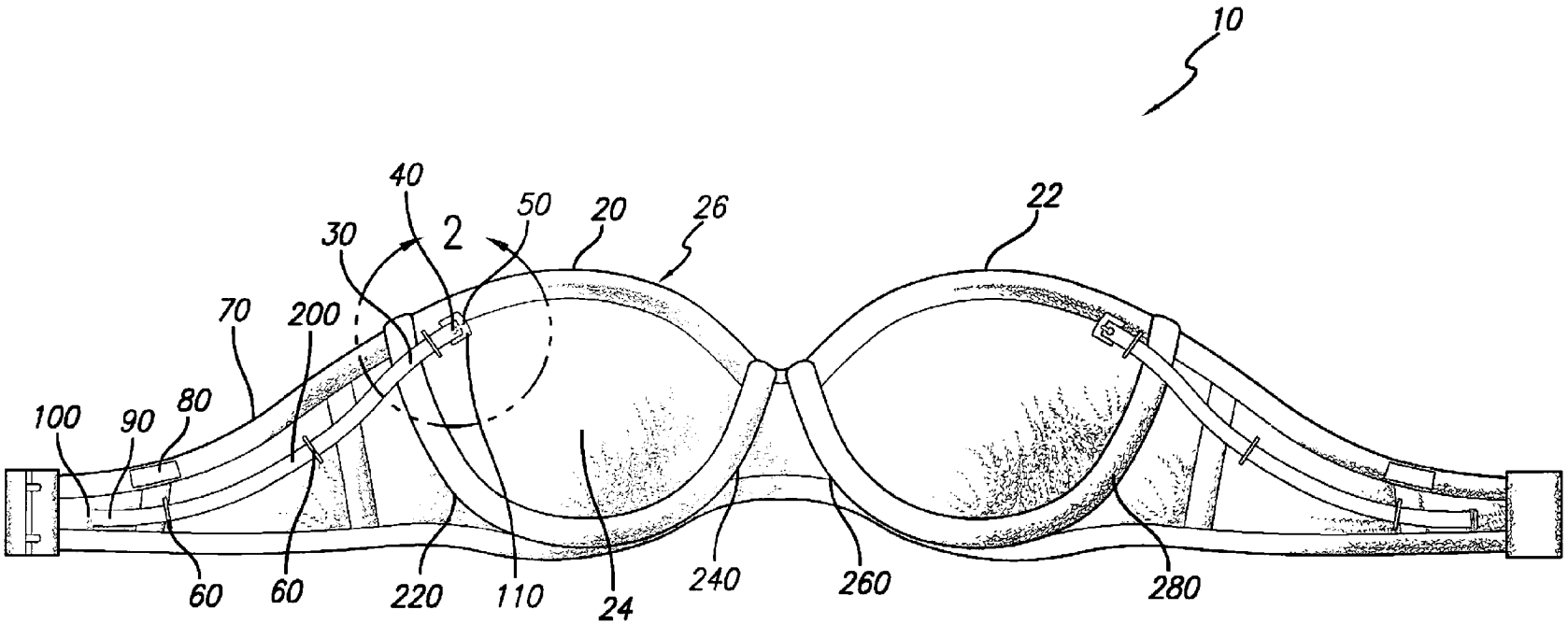
FIG. 1 depicts a convertible apparel top in the form of an undergarment top such as a brassiere with straps attached on one end to one or more swivel mechanisms or means for attaching that allow for an easy swivel of the strap on that end with respect to the apparel top. The other end of the strap may be attached in a way that allows for easy swivel or is designed to be easily detachable and reattachable. The strap or straps can be adjustable in length, but this is not required.
Figure 10:
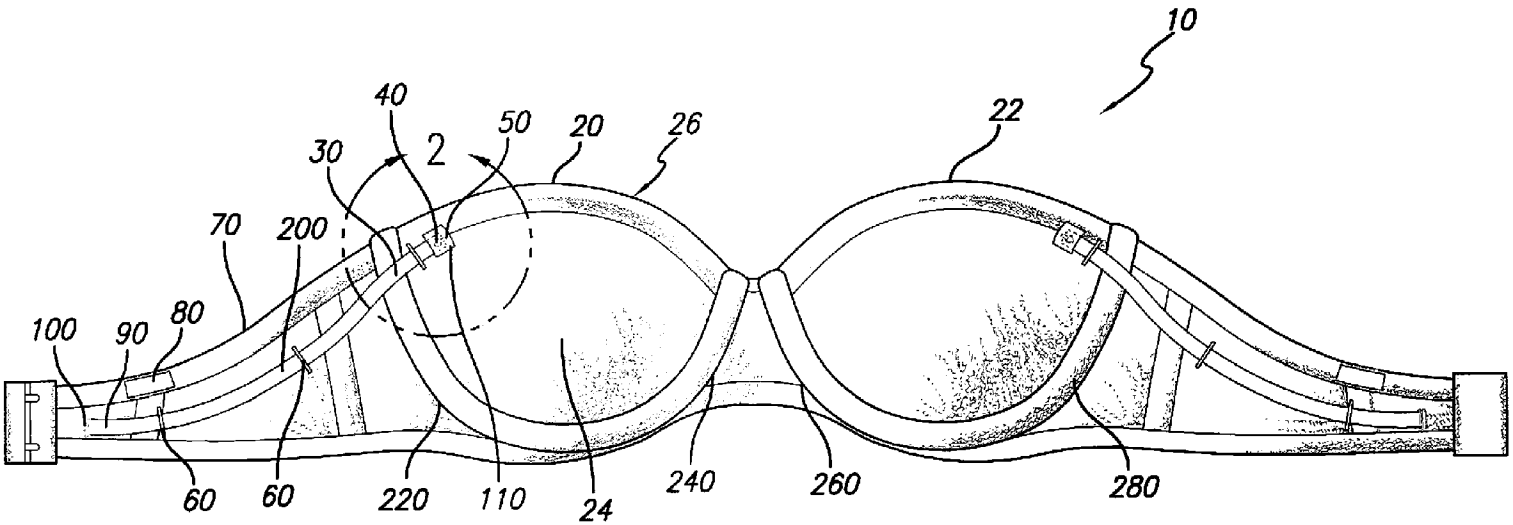
FIG. 10 depicts a convertible apparel top in the form of an undergarment top such as a brassiere with straps attached on one end to one or more swivel mechanisms or means for attaching that allow for an easy swivel of the strap on that end with respect to the apparel top wherein the swivel mechanisms are shown under a fabric sheath, the fabric sheath being over the swivel mechanism and between it and the wearer. The other end of the strap may be attached in a way that allows for easy swivel or is designed to be easily detachable and reattachable. The strap or straps can be adjustable in length, but this is not required.

FIG. 1 depicts a convertible apparel top 10 in the form of an undergarment top such as a brassiere having two cups 20 and 22, cup 20 being the first cup and cup 22 being the second cup, each cup having an inside 24 and an outside 26 and a left edge and a right edge, the left edge of the first cup 220 attached to the at least one band 70, the right edge of the second cup 280 attached to the at least one band 70, the right edge of the first cup 240 attached to the left edge of the second cup 260 with each of the straps 200 attached on a first end 30 to swivel mechanisms 50 that allow for an easy swivel of the strap on that end with respect to the apparel top. The end of the strap attached to the swivel mechanism could be rounded on the end to help facilitate the swiveling mechanism but it is not required. The second end 90 of each of the straps 200 as shown has an attachment piece 100 in the form of a hook that may be removeably received to the two releasable attachment mechanisms 80 on the inside of the bands 70. The releasable attachment mechanisms 80 are shown as a rectangular piece of fabric open on both of the narrower ends to removeably receive the attachment pieces 100. The first end 30 of each of the straps 200 have an eyelet 40. The swivel mechanism 50 is a strong material, cord, string, thread, fabric, or other material that fits through the eyelet 40 and is secured to the apparel top 10. The fabric piece 110 that the swivel mechanism 50 is attached to is shown under the swivel mechanism 50. It may be secured over the swivel mechanism 50 and the first end 30 of the strap 200 so that the strap may be pivoted and the garment will lay comfortably against the wearer. FIG. 10 depicts the fabric piece 110 shown over the swivel mechanism 50 and the first end 30 of the strap 200 so that the strap may be pivoted and the garment will lay comfortably against the wearer. In both FIGS. 1 and 10, the straps 200 are shown in the swiveled, down position and are secured against the bands 70 of the top with one or more anchors 60. Anchors may be made of smooth and/or stretchy material.

Figure 11:
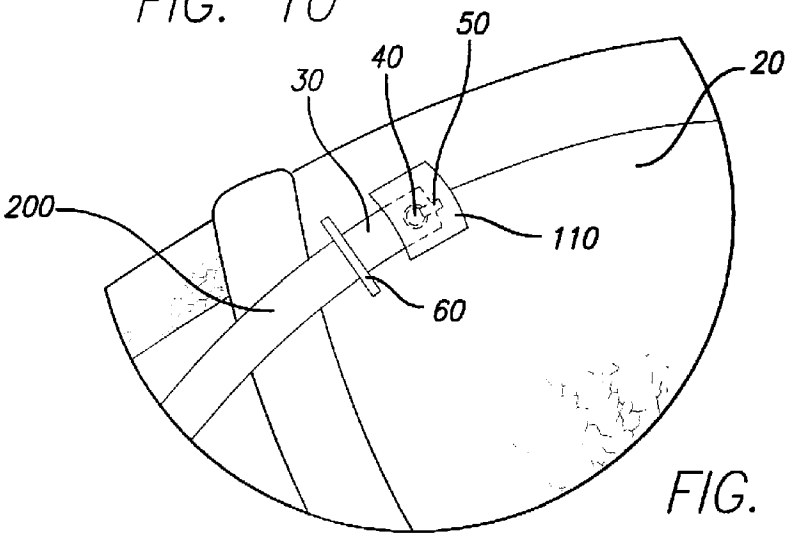
FIG. 11 is a detailed depiction of the swivel mechanism or means for attaching, and the first end of a strap when the strap is in the down position and threaded through an anchor on the garment to hold the strap in place for a strapless look wherein the swivel mechanism is shown under a fabric sheath, the fabric sheath being over the swivel mechanism and between it and the wearer.

FIG. 2 is a detailed depiction of the swivel mechanism 50 and the first end 30 of a strap 200 when the strap 200 is in the down position and threaded through an anchor 60 on the garment to hold the strap 200 in place for a strapless look. The first end 30 of the strap 200 has an eyelet 40 that receives the swivel mechanism 50. A fabric piece 110 is shown under the swivel mechanism 50, but may be secured over the swivel mechanism 50 and the first end 30 of the strap 200 so that the strap may be pivoted and the garment will lie comfortably against the wearer. FIG. 11 is a detailed depiction of the swivel mechanism 50 with the fabric piece 110 shown over the swivel mechanism 50.

FIG. 3 is a detailed depiction of the eyelet 40 in the first end 30 of the strap 200 before it is attached to the garment with the swivel mechanism 50, and the swivel mechanism 50 is shown deconstructed as a strong piece of material, thread, string, cord, or other strong material, between the first end 30 of the strap 200 such that it will be affixed to the inside of the cup 20 of the garment, and will be threaded through the eyelet 40 to hold the strap in a swiveled relation to the garment as shown in FIG. 2. The strap 200 may be held flush with the garment by placing it through an anchor 60 once it is swiveled in the down position.

Figure 4:
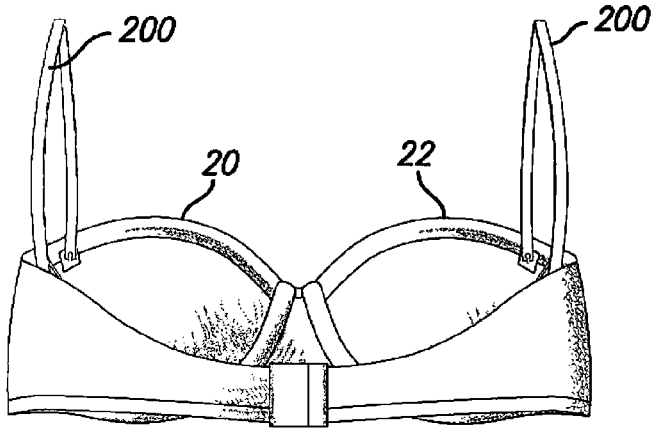
FIG. 4 is a depiction of one embodiment of the invention wherein the first ends of the straps are attached to the inside of each of the two cups with a means for attaching or swivel mechanism that is a strong piece of material holding the eyelet in the first ends of the straps in place, and the second ends of the straps are then attached to the back inside of the bodice section in parallel relation.

FIG. 4 is a depiction of one convertible apparel top embodiment of the invention wherein the first ends of the straps 200 are attached to the inside of each of the two cups 20 with a swivel mechanism that is a cord holding the eyelet in the first ends of the straps in place, and the second ends of the straps are then attached to the back inside of the bodice section in parallel relation.

Figure 5:
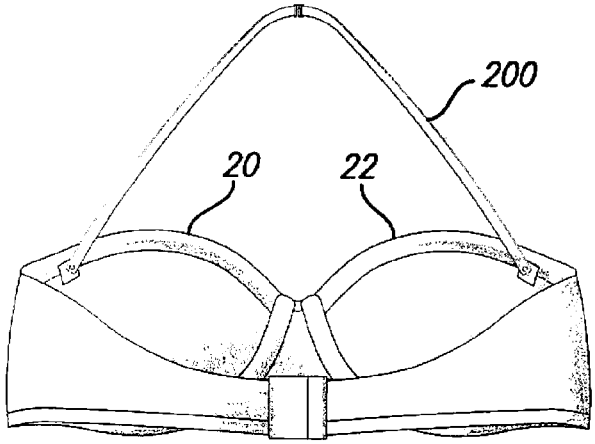
FIG. 5 is a depiction of one embodiment of the invention wherein the first ends of the straps are attached to the inside of each of the two cups with a means for attaching, also a swivel mechanism, that is a strong piece of material holding the reinforced opening in the form of an eyelet in the first ends of the straps in place, and the second ends of the straps are attached together to form a halter to fit about the neck of a wearer.

FIG. 5 is a depiction of one convertible apparel top embodiment of the invention wherein the first ends of the straps 200 are attached to the inside of each of the two cups 20 with a swivel mechanism that is a strong piece of material holding the eyelet in the first ends of the straps in place, and the second ends of the straps are attached together to form a halter to fit about the neck of a wearer.

Figure 6:
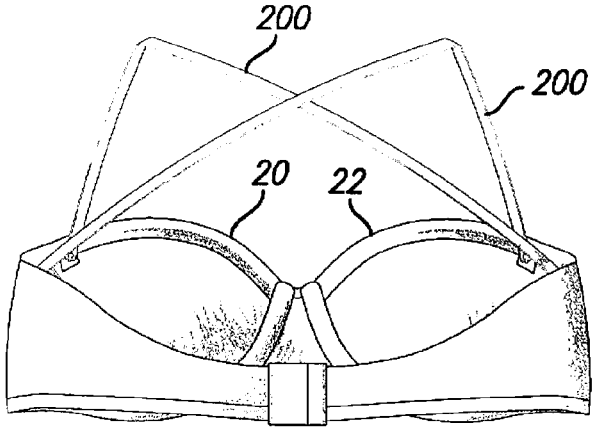
FIG. 6 is a depiction of one embodiment of the invention wherein the first ends of the straps are attached to the inside of each of the two cups with a means for attaching, also a swivel mechanism, that is a strong piece of material holding the reinforced opening in the form of an eyelet in the first ends of the straps in place, and the second ends of the straps are then attached to the back inside of the bodice section in crisscross relation.

FIG. 6 is a depiction of one convertible apparel top embodiment of the invention wherein the first ends of the straps 200 are attached to the inside of each of the two cups 20 with a swivel mechanism that is a strong piece of material holding the eyelet in the first ends of the straps in place, and the second ends of the straps are then attached to the back inside of the bodice section in crisscross relation.

Figure 7:
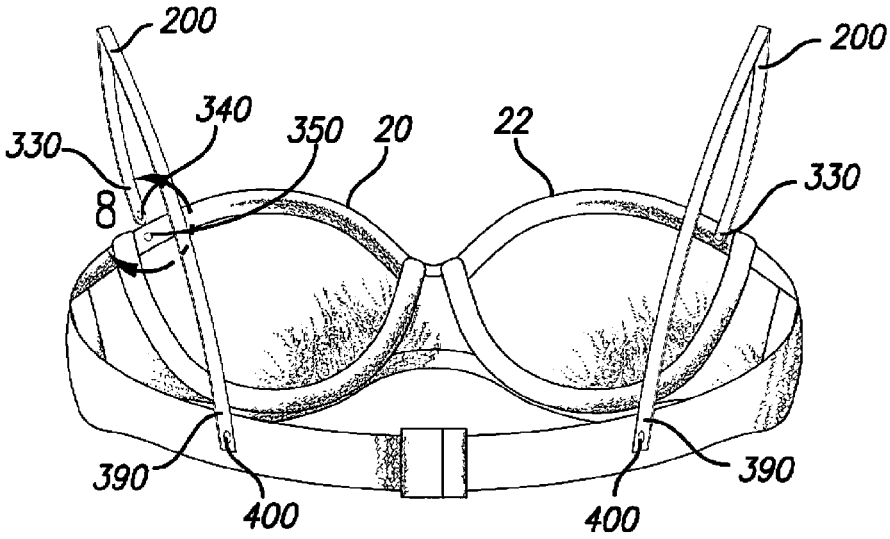
FIG. 7 is a depiction of one embodiment of the invention wherein the first ends of the straps are attached to the inside of each of the two cups with a means for attaching, also a swivel mechanism, that is a button holding the reinforced opening in the form of an eyelet in the first ends of the straps in place, and the second ends of the straps attached to the back inside of the bodice section may be capable of swiveling.

FIG. 7 is a depiction of one convertible apparel top embodiment of the invention wherein the first ends 330 of the straps 200 are attached to the inside of each of the two cups 20 with a swivel mechanism 350 that is a button holding the eyelet 340 in the first ends 330 of the straps 200 in place, and the second ends 390 of the straps 200 attached to the back outside of the bodice section may be capable of swiveling at the back swivel mechanism 400.

Figure 8:
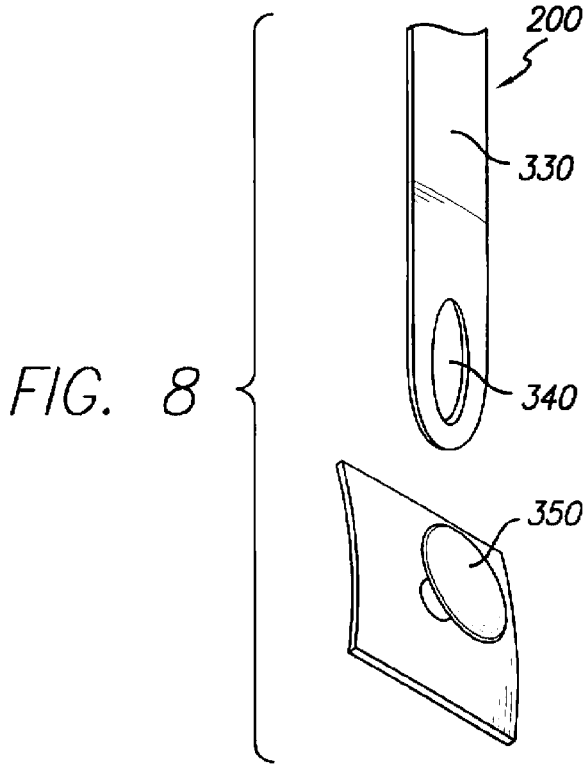
FIG. 8 is a detailed depiction of the means for attaching, also the swivel mechanism, in the form of a button that may be used in accordance with the inventive convertible apparel top.

FIG. 8 is a detailed depiction of the swivel mechanism 350 in the form of a button that may be used in accordance with the inventive convertible apparel top. The first end 330 of the strap 200 is shown with an eyelet 340 that may fit over and around the swivel mechanism 350 when constructed in accordance with the preferred embodiments of the invention.

Figure 9:
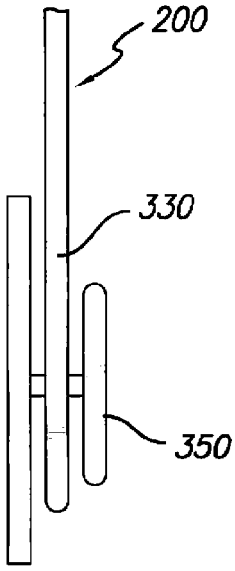
FIG. 9 is side view of a detailed depiction of the swivel mechanism or means for attaching in the form of a button that may be used in accordance with the inventive convertible apparel top, where the reinforced opening in the form of an eyelet in the first end of the strap is secured to the button and is capable of swiveling.

FIG. 9 is side view of a detailed depiction of the swivel mechanism 350 in the form of a button that may be used in accordance with the inventive convertible apparel top, where the eyelet in the first end 330 of the strap 200 is secured to the button and the strap 200 is capable of swiveling.

In one convertible apparel top embodiment of the invention, a strap is pivotably attached to the apparel top by a mechanism that is designed to allow for a swiveling motion, and placed so that the strap can switch between being vertical and going over the shoulder (or about the neck) and pivoting to go more horizontally and lie flat against the body or garment to achieve a strapless look—without creating an inadvertent twist in the strap. In a preferred embodiment, the strap is designed to be adjustable in length, but this is not required.

In another convertible apparel top embodiment, the garment and strap are attached so that there is an opening or link, pivot, other fastening, connection or fastening mechanism that permits the free turning of the strap against the garment without the strap twisting. The strap may be pivotably connected on both ends of the strap that are attached to the garment or pivotably connected to the garment on one end of the strap and designed to be easily detachable and reattachable in relation to the garment on the other end of the strap. In some cases the strap is pivotably connected by attaching the strap to the garment using a joint mechanism comprised of two pieces which turn round with respect to each other on a longitudinal pin or axis so as to allow the strap to turn in that way that prevents twisting. In the embodiment where one end of the strap is detachable from the garment, the end of the strap that is detachable can be connected to the garment and removed from the garment, or connected to the other strap.

In yet another embodiment, the shoulder strap may be attached to the apparel top by a mechanism wherein it does not have to be fully detached but still allows for the strap to hinge, pivot, revolve, rotate, swing around, or move about its axis and create going from a strapped to strapless look.

All sizes, shapes, measurements, connections, and order of assembly specifications referred to herein are not intended to be limiting. They are variable in that these specifications can be adjusted and still achieve the desired effect. For instance, what is described or pictured smooth, may be riveted and vice versa, and what is described or featured as round may also be hexagonal, square, triangular, or any other suitable shape.

In one embodiment the swivel mechanism may be a flat piece about 0.1 to 0.5 of an inch in diameter with a 0.1 to 0.4 inch rounded prong protruding from it. The tip of the prong can be any suitable shape. The piece can take on many suitable sizes and shapes as long as there is piece protruding from it that can be inserted into the garment top to form a swivel mechanism and to receive an end of a shoulder strap. The point of attachment of the prong may be reinforced with any reinforcing material (such as metal or plastic) around the garment opening if there is a concern of the garment unraveling. The two pieces of the swivel mechanism can be connected to the garment by screwing, crushing, gluing, fusing, welding, or snapping the two pieces together, or by any suitable connecting processes. This leaves the small pronged piece and the small flat piece with the raised opening connected and both the garment and small flat piece with the flat opening sandwiched between them. Then a strap can be connected to the swivel mechanism.

The swivel mechanism can have a dipped enclosure for the round prong to fit inside of or it can be alternatively shaped as long as it is designed to fit in or outside one another and connect in a lockable position that allows whatever is sandwiched between them to swivel freely around their connecting point.

In such a configuration, this process can be repeated on the other side of the garment as in a garment having four means for attaching that allow for swiveling of the straps, or four swivel mechanisms, which would allow the entire strap to swivel down inside or outside the garment with neither side of the strap detaching from the garment. The strap can also be secured in place by an anchor, snap, hook, hook and loop fastener, magnet, or other suitable means of temporarily securing the strap in a position that allows the user to achieve a strapless look. The anchor may be made of material that is smooth, stretchy, partially elastic, fully elastic, and combinations thereof. In another alternative configuration, the user may choose to wear one strap at a time. The straps themselves can be adjustable in length as with a typical brassiere strap.

In another embodiment, the means for attaching is a strong piece of material that has a miniature bowtie or hourglass shape such that the wider ends affix to the apparel and the narrower mid portion are threaded through the reinforced opening in each of the ends of the one or more straps.

In yet another embodiment, one end of the strap of the apparel top is attached to a swivel mechanism, and the other end of the strap is removeably attached to the apparel top with a hook found on a typical convertible brassiere, by a hook and loop fastener, button, snap, magnet, hook, clip, tie, pin, or any other easily detachable and reattachable means. When the strap that is easily detachable on one end is swiveled down outside the garment it can be pulled around the body and secured on the opposite end of the garment by hook and eye, hook and loop fastener, snap, tie, or other easily attachable and detachable means. When the strap that is detachable on one end is swiveled down on the inside of the garment it can be slipped through an opening or one or more anchors to keep the strap flat and in place and then temporarily attached to the inside of the garment in a way that makes it undetectable from the outside.

In yet another embodiment, the swivel mechanism may be a strong material, peg, hinge, spring, cord, button, or other suitable means such that a strap may be connected to the bodice section of the garment in a way that allows the strap to swivel. The end of the strap may be designed such that it can open and close around the strong material, peg, hinge, spring, cord, button, or other suitable place, then stays securely in place in a way that allows for a swiveling motion.

In an embodiment where the swivel mechanism is a small peg shaped piece with one side that is larger than the other it can be attached to the bodice section of the convertible apparel top, with the end of a strap with an eyelet or grommet being attached to the bodice section with the peg through the eyelet or grommet. If the small peg swivel mechanism is two pieces, the pieces can be fit together by crushing, gluing, welding, snapping, screwing, fusing, or other suitable means of connecting the two pieces. This leaves the straps and the bodice section of the convertible apparel top sandwiched between the two connecting swivel pieces. On either side of the bodice one side of the swiveling piece can be sandwiched between the strap and the bodice so that it functions to allow for a swivel but does not reveal the swivel mechanism. The swivel mechanism in all embodiments, in the front, back, inside, outside, and combinations thereof, may be covered by a fabric sheath or a piece of the fabric to prevent the swivel mechanism from touching the wearer's skin or the wearer's outer garments, or from catching on an external object when nothing is worn over the garment. If the swivel mechanism flows to the outside of the garment and is then covered with a fabric sheath or a piece of fabric in the bodice section, the covering prevents the swivel machinations from being exposed. The opening in the straps and garment may be reinforced with metal, plastic, or other suitable reinforcing material to prevent tearing of either material.

The means for attaching that permits swiveling of the one or more straps, or the swivel mechanism may have a number of configurations. In a preferred configuration at least one end of each strap is connected to swivel mechanism. Both of the straps will be capable of swiveling, and that two swivel mechanisms may be in the front of the bodice section of the garment. In an alternative embodiment, two swivel mechanisms may be in the back of the bodice section of the garment. In yet another embodiment, there may be four swivel mechanisms, two in front and two in back. This allows the entire strap to swivel down inside or outside the garment with neither side of the strap detaching from the garment. The strap can then be left inside or outside the garment or secured in place by an anchor, snap, hook, hook and loop fastener, magnet, or other suitable means of temporarily securing the strap in a position that allows the user to achieve a strapless look. The straps themselves can be adjustable in length as with a typical brassiere strap. If there are two swivel mechanisms such that one end of the strap is attached to the swivel mechanism and the other end of the strap has an attachment mechanism such as by a hook found on a typical convertible brassiere, or hook and loop fastener, button, snap, magnet, hook, clip, tie, pin, or any other easily detachable and reattachable means so that it may be removeably attached to the bodice of the convertible apparel, or to the end of the other strap. When the strap that is easily detachable on one end is swiveled down outside the garment it can be pulled around the body and secured on the opposite end of the garment by hook and eye, hook and loop fastener, snap, tie, or other easily attachable and detachable means. When the strap that is detachable on one end is swiveled down on the inside of the garment it can be slipped through an opening or one or more anchors to keep the strap flat and in place and temporarily attached to the inside of the garment in a way that makes it undetectable from the outside.

In yet another embodiment of the invention, either or both the garment and the strap can be created to have multiple openings that are arranged as to be completely separate options or are connected in such a way that the peg like (or alternate piece) can slip easily from one to the other and then stay in place in a way that still allows the strap to swivel about the garment. In this alternative embodiment, the multiple openings can be used to adjust the fit between the garment and straps and the fit of the garment or strap on the body.

In any of the aforementioned embodiments, the ends of the straps may be reinforced to prevent unraveling of more delicate materials from which the strap may be made. Reinforcement can be made of strong thread, multiple stitches, leather, metal, copper, plastic, or any other suitable material, and reinforcement is a viable option but not required. If the end of a strap is an eyelet or grommet, the opening may be flexible and stretchable so that it can stretch slightly and slip over a swivel mechanism that is in the form of a button or peg. The button or peg can be made of plastic or any other suitable material and can be attached to the garment by sewing, fusing, or any other suitable means. If the end of the strap is not a flexible material and the swivel mechanism is a button or peg, the wide portion of the peg or button shaped piece could be made of a material (for example rubber) that allows it to fold and slip through the eyelet, grommet, and/or opening in the end of the strap and then re-expand to lock itself so that the strap will be pivotably sandwiched between the wide portion of the peg or button shaped piece and the base of the peg shaped piece that is affixed to the bodice of the garment. Some rubber materials are suitable for this, but any material or combination of materials that achieve this end are suitable.

If neither piece is made of a flexible type material then one could have the entire peg or button shaped piece with one wider outer face and one narrower portion closest to the garment. The eyelet, grommet, and/or opening in the end of the strap is then positioned so that the narrower portion fits therethrough and is secured because it cannot slip or fit over the wider outer face. The end result is that the strap can be swiveled. The peg or button can be affixed to the garment by sewing, crushing, welding or other suitable means such that the garment opening is now pivotably sandwiched between the wider portion of the peg shaped piece and its base. Alternatively, the opening in the strap itself could be designed such that it can open and close around the peg area or other suitable place, then stays securely in place in a way that allows for a swiveling motion. Also the swivel mechanism pieces may be connected by hinge, spring, or other suitable means such that they can remain connected yet separate, allow for the insertion of the opening in the strap and the opening in the garment, and then re-close in a way that allows the strap to swivel. Also, the tip of the narrower portion of the peg shaped piece in the swivel mechanism may come to a point or create any other suitable shape.

Either or both the garment and the strap can be created to have multiple openings that are arranged as to be completely separate options or are connected in such a way that the peg like (or alternate piece) can slip easily from one opening in the garment or strap to a contiguous opening in the garment or strap then stay in place in a way that still allows the strap remain pivotably connected to the garment. As a result, the fit between the garment and straps and the fit of the garment or strap on the body.

In yet another alternative embodiment, where the swivel mechanism includes a rod, the end of the strap can be attached or wrapped around the rod portion of the swivel mechanism. This allows the strap to swivel in and out from the garment such that it could go up over the shoulder or neck and then swivel down (or up) to lie flat against the garment to give the wearer the option of a strapless look.

In yet another embodiment, the swivel mechanism is a strong material, cord, string, thread, or any suitable material including elastic or other stretchy materials that are affixed through the reinforced opening, eyelet, grommet, suitable means of reinforcement, or fortified end of the strap to the apparel. It may be affixed to the apparel by sewing, clipping, buttoning, snapping, any other suitable means, and combinations thereof. This allows the strap to have 45 degree to 360 degree movement and allows the wearer go from a strapped to strapless look without having to have the straps be removable in their entirety. The second end of the strap may be removeably attached to the apparel top. When the second end is removeably attached, the user may detach one end of the strap, move it under the arm and then reattach it to the garment by way of one or more anchors. This provides a strapless look while maintaining both straps on the apparel top, thereby preventing loss of one or both of the straps as can happen when the straps are detachable at both ends.

In yet another embodiment there is one long strap, the middle portion of which is affixed to the clothing horizontally such that the ends are left to be able to freely be rotated 360 degrees. The wearer brings the end of each strap over the shoulder or neck and then affixes it to the other end by hook, tie, or other easily detachable and re-attachable means. A variation of this can also involve two separate straps that are still set up in the same way.

In an embodiment where the swivel mechanism is a peg shaped material, the peg may or may not come to a point and may be flatter and wider on one side than the other. The peg of the swivel mechanism may be pierced through the fabric of a strap or slipped through a preplaced opening in the strap, and then pierced through the garment or slipped through preplaced openings. The peg shaped piece may be made of plastic or a kind of metal, but many other materials are acceptable replacements. On the side of the peg shaped piece that protrudes from the larger flatter piece the peg may be serrated or otherwise designed to split open. Therefore, once the peg shaped piece is slipped through the strap and garment it can be folded or split open at its perforations or otherwise pre-separated points so that the strap and garment are now sandwiched between the peg and itself and are free to swivel in relation to one another.

In yet another embodiment, the end of each strap has a sturdy piece of material such as plastic, metal, wire, or other acceptable material that has been twisted, welded, or otherwise molded into the general outline of a fish with a rounded body the rounded side of which is then slipped onto the swivel mechanism which may be a small peg shaped piece made of plastic, metal rubber, or other acceptable material that is wider on one end that the other and affixed to the garment. The end of the strap may also be slipped through the wide rounded side of the swivel mechanism and then through the fabric rather than being affixed to the garment at the start. The strap can also be slipped through the more triangular end of the outline of a fish as described above, and affixed back to itself by sewing, gluing, industrial staple, or any other suitable method. The swivel mechanism may be rubber or its equivalent, or another suitable material to keep it in place so that it does not simply slip back out of the garment.

In all embodiments of the invention the convertible apparel top with swivel straps provides a simpler way to convert a top from a strapped to a strapless look without risk of separating the straps from the garment. While the above description contains many embodiments, these should not be constructed as limitations on the scope of the invention, but rather as an exemplification of several embodiments thereof.

For example other suitable embodiments involve the end of the strap that needs to swivel being attached to a swivel mechanism that is a socket and hinge or other similar component. Another embodiment exists wherein the swivel end of the strap is achieved with the strap having a semi rounded slit that then goes over a swivel mechanism that is a button or other suitable piece. An additional embodiment also exists where the swivel end is achieved by the strap and apparel top being attached by a swivel mechanism that is a rotatable snap. In another embodiment, the swivel mechanism is made of material that attaches to the garment and goes through the end of each strap thereby allowing the strap to swivel around itself in a way that it does not have to twist up if the wearer does not want it to. Materials such as rope, cord, string, rubber, elastic or their equivalents may be used for the swivel mechanism.

Also there are a multitude of suitable variations involving adding a single element or multiple elements to the strap and or garment such that a swivel motion can be achieved between the strap and the garment. All of these variations are suitable. Also adding elements such as springs, elastics, motorization, computerization, robotics, electrical, mechanized, self moving, self starting, or similar elements are also acceptable and have benefits.

The straps in all aforementioned or derivative embodiments may be attached through multiple means including tying around swiveling element.

While there is disclosed what are considered to be preferred embodiments of the invention, other modifications will occur to those skilled in the art and it is desired to secure in the appended claims all such modifications as fall within the true spirit and scope of the invention.

INDUSTRIAL APPLICABILITY

The inventive devices have industrial applicability to the fashion industry and all other industries where garments and appearance is important such as modeling, acting, advertising, commercial and film production, and is important for individuals who don the inventive devices and the respective industries of involvement of these individuals.

What is claimed is:

1. A convertible bra comprising:

(a) two cups, a first cup and a second cup with each cup having a left edge and a right edge and an inside and an outside, the left edge of the first cup attached to at least one band having an inside and an outside, and the right edge of the second cup attached to the at least one band, the right edge of the first cup attached to the left edge of the second cup, wherein the first cup, second cup, and the at least one band encircle a wearer's torso, (b) a swivel mechanism attached to the inside of each of the cups, (c) one or more shoulder straps, each having a first end and a second end, the first end of each shoulder strap having an eyelet reinforced opening that is attached to the swivel mechanism, the swivel mechanism being a strong piece of material affixed to the inside of each cup, wherein the swivel mechanism passes through the eyelet opening in the first end of each shoulder strap to secure the first end of each strap to each of the cups and to permit the straps to swivel, and the second end of each shoulder strap having an attachment piece, the attachment piece being a hook, wherein the attachment piece allows for the second end of the strap to be attached and detached from one or more releasable attachment mechanisms on the inside of the at least one band to removably receive each attachment piece on the second end of each shoulder strap, (d) a fabric sheath over the swivel mechanism, the fabric sheath being between the swivel mechanism and the wearer, and (e) one or more anchors on the inside of the at least one band to removeably receive each shoulder strap, the swivel mechanism permitting movement of each shoulder strap so that the position of each shoulder strap can be modified so that the convertible bra has multiple configurations, and each attachment piece on the second end of each shoulder straps being configured to removably engage each of the one or more releasable attachment mechanisms on the band.

2. The convertible bra of claim 1, each shoulder strap being adjustable in length, the length enabling each shoulder strap to extend from the swivel mechanism to the one or more releasable attachment mechanisms on the inside of the at least one band over a shoulder of the wearer, such that the shoulder straps are generally parallel to each other.

3. The convertible bra of claim 1, the shoulder straps being adjustable in length, the length enabling each shoulder strap to extend from the swivel mechanism to the one or more attachment pieces on the second end of each shoulder strap about the neck of a wearer.

4. The convertible bra of claim 1, each shoulder strap being adjustable in length, the length enabling each shoulder strap to extend from the swivel mechanisms to the one or more releasable attachment mechanisms on the inside of the at least one band over the shoulder of a wearer, and the shoulder straps are in a crisscross formation.

5. A method of converting a convertible bra from a conventional first configuration to a second strapless configuration, while maintaining attachment of the one or more shoulder straps including the steps of:

providing a bra comprising a first cup and a second cup with each cup having a left edge and a right edge and an inside and an outside the left edge of the first cup attached to at least one band having an inside and an outside, and the right edge of the second cup attached to the at least one band, and the right edge of the first cup attached to the left edge of the second cup wherein the first cup, second cup, and at least one band encircle a wearer's torso, a swivel mechanism attached to the inside of each of the cups, one or more shoulder straps, each having a first end and a second end, the first end of each shoulder strap having an eyelet reinforced opening that is attached to the swivel mechanism, the swivel mechanism being a strong piece of material affixed to the inside of each cup, wherein the swivel mechanism passes through the eyelet opening in the first end of each shoulder strap to secure the first end of each strap to each of the cups and to permit the straps to swivel, and the second end of each shoulder strap having an attachment piece, the attachment piece being a hook, wherein the attachment piece allows for the second end of the strap to be attached and detached from one or more releasable attachment mechanisms on the inside of the at least one band to removable receive each attachment piece on the second end of each shoulder strap a fabric sheath over the swivel mechanism, the fabric sheath being between the swivel mechanism and the wearer, and one or more anchors on the inside of the at least one band to removeably receive each shoulder strap, the swivel mechanism permitting movement of each shoulder strap so that the position of each shoulder strap can be modified so that the bra has multiple configurations, and each attachment piece on the second end of each shoulder strap being configured to removably engage each of the one or more releasable attachment mechanisms on the band and converting the bra by (i) detaching the second ends of each of the shoulder straps from the at least one band, (ii) swiveling each of the shoulder straps towards the at least one band, and (iii) inserting each of the shoulder straps in the one or more anchors on the at least one band.

6. The convertible bra of claim 1 wherein the strong piece of material affixed to the inside of each cup has a length longer than a width, the width being variable, and a top edge, a bottom edge, and a middle section, the top edge and the bottom edge being wider than the middle section, the top edge and the bottom edge affixed to the inside of each cup and the middle section passing through the eyelet opening in the first end of each shoulder strap to secure the first end of each strap to each of the cups and to permit the straps to swivel.

* * * * *